United States Patent [19]

Belopolsky

[11] Patent Number: 4,533,896

[45] Date of Patent: Aug. 6, 1985

[54] FUSE FOR THICK FILM DEVICE

[75] Inventor: Yakov Belopolsky, Nepean, Canada

[73] Assignee: Northern Telecom Limited, Montreal, Canada

[21] Appl. No.: 555,339

[22] Filed: Nov. 28, 1983

[51] Int. Cl.[3] ..... H01H 85/16

[52] U.S. Cl. ..... 337/232; 219/517; 219/253; 219/543; 337/142; 337/160; 337/295; 337/231; 338/309

[58] Field of Search ..... 219/212, 253, 512, 517, 219/528, 543; 338/309, 195, 305, 309, 314; 29/620; 337/142, 145, 160, 180, 187, 191, 229, 231, 232, 290, 292, 295, 401

[56] References Cited

U.S. PATENT DOCUMENTS

| | | | |
|---|---|---|---|
| 2,222,936 | 11/1940 | Coffin | 337/290 X |
| 2,532,078 | 11/1950 | Baxter | 337/231 X |
| 2,599,646 | 6/1952 | Kozacka | 337/160 |
| 2,638,521 | 5/1953 | Thomas | 337/160 X |
| 2,665,348 | 1/1954 | Kozacka | 337/231 X |
| 3,386,063 | 5/1968 | Mansfield, Jr. | 337/191 |
| 3,417,229 | 12/1968 | Shomphe et al. | 219/517 X |
| 3,423,567 | 1/1969 | Mills | 219/517 X |
| 3,423,574 | 1/1969 | Shomphe et al. | 219/528 |
| 3,573,703 | 4/1971 | Burkes et al. | 338/309 |
| 3,787,965 | 1/1974 | Cocca et al. | 29/620 |
| 3,924,099 | 12/1975 | Housel | 219/371 |
| 3,958,206 | 5/1976 | Klint | 337/160 X |
| 4,197,521 | 4/1980 | Rovnyak | 338/195 |
| 4,245,208 | 1/1981 | Belcher | 337/231 |
| 4,254,394 | 3/1981 | Kozacka et al. | 337/231 |
| 4,293,839 | 10/1981 | Asada et al. | 338/309 |
| 4,319,126 | 3/1982 | Lujic | 219/512 |
| 4,404,537 | 9/1983 | Arikawa | 337/232 |
| 4,409,582 | 10/1983 | Kimmel et al. | 337/231 |
| 4,433,231 | 2/1984 | Balchunas | 219/253 |

FOREIGN PATENT DOCUMENTS

| | | | |
|---|---|---|---|
| 713180 | 7/1965 | Canada | 337/160 |
| 887592 | 1/1962 | United Kingdom | 337/160 |
| 524248 | 11/1978 | U.S.S.R. | 337/142 |
| 748569 | 7/1980 | U.S.S.R. | 337/142 |

*Primary Examiner*—Volodymyr Y. Mayewsky
*Attorney, Agent, or Firm*—Robert C. Hogeboom

[57] ABSTRACT

A fuse is disclosed for protecting thick film devices. The fuse comprises two blocks of material mounted to the substrate that carries the thick film device. The blocks are mounted in close proximity to one another, in axial alignment, but in a spaced apart relationship. An electrically conductive fusible link (e.g. solder) straddles the two blocks so as to complete an electric circuit.

9 Claims, 3 Drawing Figures

FUSE FOR THICK FILM DEVICE

BACKGROUND OF THE INVENTION

This invention relates generally to fuses, and more particularly to a fuse arrangement for thick film circuits.

Thick film resistors are well known and are commonly formed by applying a paste of a resistive material onto an insulating substrate; the applied resistive material is then dried and hardened by the application of heat. The magnitude of the resistance of such a resistor depends upon the thickness of the resistive material, the composition of the material, and upon the extent of the area of the substrate covered with the resistive material.

One application of thick film resistors is as battery feed resistors in battery feed circuits for telephones. In such an application a source of power (e.g. a battery) is connected to a balanced two-wire subscriber telephone line (sometimes referred to as a loop) via two battery feed resistors in order to provide current to the line. The two battery feed resistors should be closely matched to each other in order to maintain the balance of the line, and are preferably small in physical size. The battery feed resistors should also be able to limit current on extremely short loops to safe values; at the same time they must be capable of carrying large currents that may arise from fault conditions (e.g. current surges due to lightning).

The following U.S. patents depict various thick film resistors and attention is directed to them: U.S. Pat. No. 3,573,703 dated Apr. 6, 1971 by D. P. Burks et al; U.S. Pat. No. 3,787,965 dated Jan. 29, 1974 by T. F. Cocca et al; and U.S. Pat. No. 4,293,839 dated Oct. 6, 1981 by E. Asada et al.

It can be seen that the above-mentioned patents are silent on the issue of fusing. U.S. Pat. No. 4,197,521 dated Apr. 8, 1980 by R. M. Rovnyak is directed to the issue of fusing a resistor used in a telephone line circuit. In fact, that patent is directed to making the resistor itself be a fusible element, and does not describe a separate and discrete fuse.

SUMMARY OF THE INVENTION

The present invention relates to a fuse particularly suited for mounting on the substrate of a thick film device, such as a substrate supporting a thick film resistor. The fuse is of course connected in series to the resistor and is designed to rupture, thereby opening the electrical circuit, before damage occurs to the resistor.

Two solder pads are provided on the substrate for mounting the fuse. The fuse itself comprises two blocks of material, one soldered to each solder pad, and a fusible link joining the two blocks. The fusible link is tubular in shape and protrudes into a mating hole in each block. The mating hole is a little larger than necessary to accept the fusible link; the purpose of this is to allow molten material from the fusible link to move into the hole (due to capillary action) when the fusible link melts due to excessive heat.

Stated in other terms, the present invention is a fuse, for mounting on an electrically insulative substrate to protect a thick film device mounted on the substrate and connected electrically in series with the fuse, the fuse characterized by: two electrically conductive terminal block means, for electrical connection to electrodes carried by the substrate, the two block means in close proximity to one another, in axial alignment, but in a spaced apart relationship; and an electrically conductive fusible link means straddling the two terminal block means and electrically connected thereto so as to complete an electric circuit between the two block means.

BRIEF DESCRIPTION OF THE DRAWINGS

The invention will now be described in more detail with reference to the accompanying drawings, wherein like parts in each of the several figures are identified by the same reference character, and wherein.

DETAILED DESCRIPTION

Figure 1:
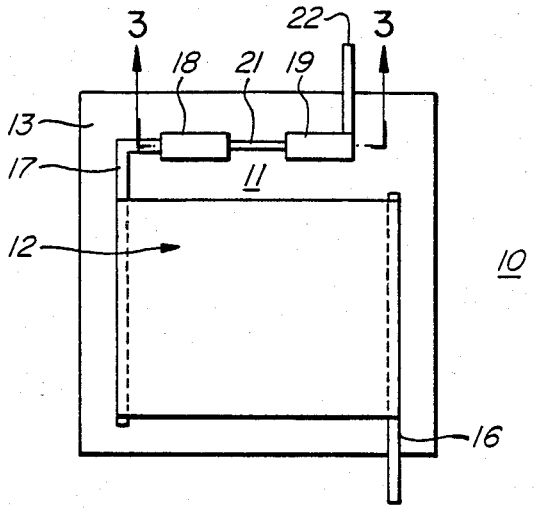
FIG. 1 is a plan view of a thick film device depicting a fuse constructed according to the present invention.

FIG. 1 depicts a thick film resistor 10 and a fuse 11. Resistor 10 comprises a layer 12 of resistive material deposited on the top face of a solid rectangular ceramic substrate 13. Electrodes 16 and 17 provide electrical connections to opposite ends of layer 12. Electrode 16 serves as a terminal electrode for resistor 10, and electrode 17 provides an electrical connection from the other end of resistor 10 to terminal 18 of fuse 11.

Fusible link 21 provides an electrical connection between terminal blocks 18 and 19 of fuse 11, and terminal block 19 connects to electrode 22. In short, the electrical path through the combination of resistor 10 and fuse 11 is as follows: electrode 16, layer 12 of resistive material, electrode 17, terminal block 18, fusible link 21, terminal block 19, and electrode 22; or vice-versa.

Figure 2:
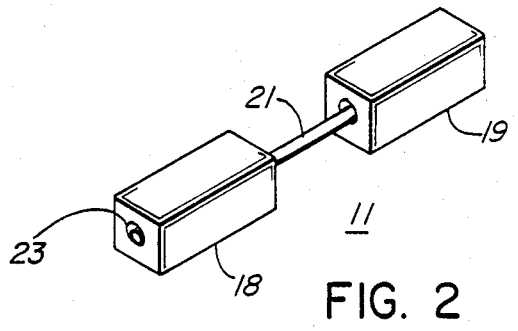
FIG. 2 is a perspective view of the fuse from FIG. 1.
Figure 3:
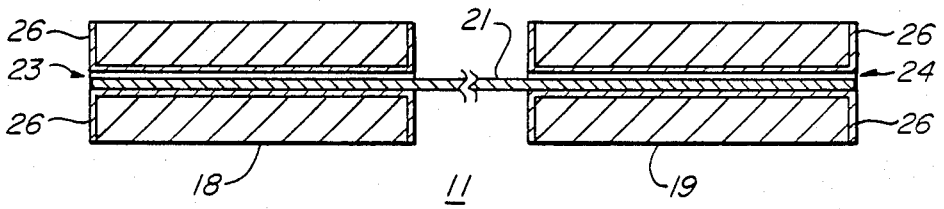
FIG. 3 is a sectional view of the fuse taken along the section line 3—3 of FIG. 1.

FIG. 2 depicts a perspective view of fuse 11 by itself. From FIG. 2 it can be seen that terminal blocks 18 and 19 are rectangular in cross-section, and a hole extends longitudinally through them for their complete length. Fusible link 21 extends between blocks 18 and 19 and extends through the holes in blocks 18 and 19 as can be seen in FIG. 3. Blocks 18 and 19, in the exemplary embodiment, are each approximately $\frac{1}{8}$ inch long and are spaced apart by approximately 1/16 inch.

FIG. 3 depicts a cross-section of fuse 11 taken along the section line 3—3 of FIG. 1. It can be seen that there is a hole 23 that extends the full length of terminal block 18 and a hole 24 that extends the full length of terminal block 19. Fusible link 21 extends between blocks 18 and 19 and also extends the full length of holes 23 and 24 as depicted.

Note that blocks 18 and 19 are made of a material that is a good conductor of both heat and electricity, such as copper. Note also that blocks 18 and 19 are coated on their end surfaces and the inside surface of holes 23 and 24, with a layer 26 of a relatively low melting point (e.g. 232° C.) solder. Layer 26 is preferably applied by an electrolysis process. Note also that fusible link 21 is preferably a length of flux-core solder with a melting point (e.g. 301° C.) higher than that of layer 26.

Note also that holes 23 and 24 are somewhat larger in diameter than is necessary to accept fusible link 21. The reason for this is to provide for a "capillary" effect when link 21 melts, thereby causing the link 21 which is in a liquid state to enter into holes 23 and 24 and to thereby minimize the escape of any of the material forming link 21.

To assemble fuse 1l, the blocks 18 and 19 are aligned and the fusible link is inserted between and through the two blocks. The assembly is then heated to a temperature higher than that of the melting point of layer 26 (but lower than the melting point of fusible link 21). It is then allowed to cool to ambient temperatures. The assembly can then be soldered onto electrodes carried by substrate 13 (FIG. 1). In the preferred embodiment this soldering is carried out with the use of a solder flux paste (95% tin, 5% silver), having a melting point of approximately 232° C., applied to the electrodes.

In normal operation, the temperature of the resistor and fuse assembly will rise. If the temperature rises too much (due either to electrical load, or ambient conditions, or both), then solder layer 26 becomes molten. If the temperature continues to rise, fusible link 21 will also become molten. When link 21 becomes molten, the liquid material from link 21, is absorbed into holes 23 and 24 due to capillary action.

Note that in the preferred embodiment holes 23 and 24 are approximately 0.034 inches in diameter and fusible link 21 is a piece of flux-core solder (with 5 flux conduits) approximately 0.350 inches long, 0.028 inches in diameter and is comprised of 93.5% lead, 5.0% tin, and 1.5% silver and melts at approximately 301° C. Layer 26 is comprised of 100% tin and melts at approximately 232° C.

What is claimed is:

1. A fuse, for mounting on an electrically insulative substrate to protect a thick film device mounted on said substrate and connected electrically in series with said fuse, said fuse characterized by:

two electrically conductive terminal block means, for electrical connection to electrodes carried by said substrate, said two block means in close proximity to one anther, in axial alignment, but in a spaced apart relationship; and an electrically conductive fusible link means protruding into respective mating holes in each of said two terminal block means and electrically connected thereto so as to complete an electric circuit between said two block means whereby said mating holes are larger than necessary to accept said fusible link, so as to allow molten material from the fusible link to move into said mating holes due to capillary action when said fusible link melts due to excessive heat.

2. The fuse of claim 1 wherein said thick film device is a resistor.

3. The fuse of claim 2 wherein said fusible link is comprised of solder.

4. The fuse of claim 2 wherein said fusible link is a piece of flux-core solder.

5. The fuse of claim 3 wherein said two terminal block means are each rectangular parallelepipeds.

6. A fuse, for mounting on an electrically insulative substrate in order to protect a thick film resistor mounted on said substrate and connected electrically in series with said fuse, from overheating, said fuse characterized by:

two electrically conductive terminal block means, for electical connection to electrodes carried by said substrate, said two block means in close proximity to one another, in axial alignment, but in a spaced apart relationship, and having holes extending therethrough; and an electrically conductive fusible link means electrically interconnecting said two terminal block means so as to complete an electric circuit, whereby said fusible link means melts under a condition of elevated temperature and molten material from said fusible link means is drawn into said holes in said terminal block means by capillary action, thereby breaking said electric circuit.

7. The fuse of claim 6 wherein said fusible link means is connected to said two terminal block means with a solder having a lower melting point than the melting point of said fusible link.

8. The fuse of claim 7 wherein said fusible link means is a piece of solder.

9. The fuse of claim 6 further characterized by:

said terminal blocks being in the shape of rectangular parallelepipeds, and said fusible link being soldered to said terminal blocks with solder having a melting point lower than the melting point of said fusible link.

* * * * *